US005420475A

United States Patent [19]

Nakamura et al.

[11] Patent Number: 5,420,475

[45] Date of Patent: May 30, 1995

[54] CATHODE-RAY TUBE

[75] Inventors: Koji Nakamura, Nagaokakyo; Keitaro Tsukui, Amagasaki; Junko Itoh, Amagasaki, all of Japan

[73] Assignee: Mitsubishi Denki Kabushiki Kaisha, Tokyo, Japan

[21] Appl. No.: 659,688

[22] Filed: Feb. 25, 1991

[30] Foreign Application Priority Data

Feb. 26, 1990 [JP] Japan ..... 2-46956

[51] Int. Cl.[6] ..... H01J 31/12

[52] U.S. Cl. ..... 313/474

[58] Field of Search ..... 313/474, 478, 479

[56] References Cited

U.S. PATENT DOCUMENTS

| | | | |
|---|---|---|---|
| 3,610,994 | 10/1971 | Sheldon | 313/478 X |
| 4,065,697 | 12/1977 | Steierman . | |
| 4,485,329 | 11/1984 | Donofrio et al. | 313/478 |
| 4,568,852 | 2/1986 | Kobayashi et al. | 313/36 |
| 4,926,090 | 5/1990 | Rein . | |

FOREIGN PATENT DOCUMENTS

| | | |
|---|---|---|
| 1564395 | 3/1966 | Germany . |
| 1305000 | 1/1973 | Germany . |
| 08360A1 | 9/1983 | Germany . |
| 43088A1 | 6/1988 | Germany . |
| 1-224242 | 9/1989 | Japan . |

OTHER PUBLICATIONS

Radio Shack Dictionary of Electronics 1974, p. 656.

*Primary Examiner*—Sandra L. O'Shea

[57] ABSTRACT

A cathode-ray tube includes a screen region, for displaying images, which consists of two glass layers. An exterior glass layer is formed of glass having a higher X-ray absorption coefficient. An interior glass layer is formed of glass which hardly causes browning. These exterior and interior glasses are connected together by the process of adhesion for example.

19 Claims, 3 Drawing Sheets

(Z-Y)

(Z-X)

(Z-P)

CATHODE-RAY TUBE

BACKGROUND OF THE INVENTION

Field of the Invention

This invention relates to a cathode-ray tube and, more particularly, to the structure of a face panel of the tube.

Description or the Related Arts

A large amount or cathode-ray tubes are now used, for example, in the form of a picture tube in a television receiver for domestic use.

Since the cathode-ray tube must maintain a high vacuum, i.e., not less than $10^{-8}$ Tort, inside of it, a robust structure is naturally required. That is to say, the cathode-ray tube is always required to have a sufficient strength against implosion.

In view of this point, glass, a component of the cathode-ray tube, should preferably be as thick as possible.

Meanwhile, the cathode-ray tube is also used in various fields, and therefore the cathode-ray tube is expected to be light In weight and inexpensive as well.

Further from this view point, glass, a component of the cathode-ray tube, should desirably be as thin as possible.

Thus, in respect of the thickness of glass, there are two requests contrary to each other, and therefore there has been a strong demand in designing the cathode-ray tube for reducing the weight with a sufficient strength secured.

FIG. 6 of the accompanying drawings shows a side elevation view of a conventional cathode-ray tube.

This cathode-ray tube 1 consists of: a neck portion 2 one small opening of which is tipped off and incorporates an electron gun; a funnel-shaped cone portion 3 elongated from the small opening to the other large opening; and a face panel 4 for sealing off the large opening of the cone portion 3.

Further, the face panel 4 includes a screen region 4A for displaying an image and a skirt region 4B elongated from the periphery of the screen region 4A.

Here, the skirt portion 4B is sealed with the large opening of the cone portion 3. The sealed area is designated by numeral 7.

On the inside of the screen region 4A is deposited a phosphor layer 8 upon which electron beams are bombarded.

The stress distribution of the cathode-ray tube 1 will be explained hereunder.

First, the rectangular coordinate system of X-Y-Z is defined on the face panel as shown in FIG. 7. Specifically, the axis Z is oriented to an axis, made between the center of the screen region 4 and the neck portion 2, and the axes X, Y are oriented along the surface of the screen region 4A. These axes X and Y are respectively oriented so as to traverse across shorter sides and longer sides of the screen region with a right angle. Moreover, an axis P is oriented to a diagonal direction of the rectangular screen region 4A.

FIG. 5A, 5B and 5C designates the stress distribution of each area of the conventional cathode-ray tube 1 illustrated in FIG. 6.

FIG. 5A shows the stress distribution in the Z-Y plane; FIG. 5B, the stress distribution in the Z-X plane; and FIG. 5C, the stress distribution in the Z-P plane.

Throughout the drawings, the stress distribution 100*a*, 100*b* and 100*c* are indicated by broken lines. The broken lines are outside of the frame of the cathode-ray tube 1 when the stress is a tensile stress, whereas the lines are inside of the frame of the cathode-ray tube 1 when the stress is a compressive stress.

As illustrated in the drawings, the tensile stress is produced over the area from the periphery of the screen region 4A to the sealed area 7. In consequence, the overall thickness of the cathode-ray tube can be reduced if such area to which the stress concentrates is intensively strengthened. In short, if glass is thickened solely at the area necessary to be strengthen considering the aforementioned stress distribution, it will be possible to fabricate the cathode-ray tube having a sufficient strength against implosion even if the thickness of glass is reduced at the other area.

However, if glass is reduced at the screen region 4A in order to decrease the overall weight of the cathode-ray tube, a large amount of X-rays would leak from the screen region 4A.

Namely, In the conventional cathode-ray tube, the screen region Is formed of glass having a certain degree of thickness, wherefore the reduction of glass in thickness would result in X-ray leakage.

The present invention is aimed to solve the drawbacks with the prior arts as set forth, and an object of the invention is to provide a cathode-ray tube which can be designed which is light in weight as well as on which can prevent X-ray leakage.

SUMMARY OF THE INVENTION

To achieve this aim, in accordance with one aspect of the present invention, there is provided a cathode-ray tube comprising a screen region composed of an exterior layer formed of glass having a X-ray absorption coefficient and an interior layer formed of glass having a X-ray absorption coefficient different to that of the exterior layer, thereby preventing the X-ray leakage from the screen region.

Here, the exterior layer is formed of a material having a larger X-ray absorption coefficient, while on the contrary, the interior layer is formed of a material having a smaller X-ray absorption coefficient.

Particularly, as compared with the convention cathode-ray tube, X-ray leakage can be prevented with the thickness of glass reduced by means of disposing glass having a high X-ray absorption coefficient at the screen region.

In practice, if the whole screen region is formed of glass having a high X-ray absorption coefficient, so-called Browning readily occurs. To prevent this phenomenon, there is disposed an existing glass as the inner surface of the screen.

Browning, as publicly known, is coloration of glass caused by the bombardment of electron beams against glass.

BRIEF DESCRIPTION OF THE ACCOMPANYING DRAWINGS

DETAILED DESCRIPTION OF THE INVENTION

Referring to the accompanying drawings, preferred embodiments of the present invention will be described hereinbelow.

FIGS. 1 to 4 show the partially enlarged view of a screen of cathode-ray tubes embodying the present invention. This invention is characterized in the structure of the screen region, and therefore illustrations of the other portions of the cathode-ray tube are omitted.

First Preferred Embodiment

Figure 1:
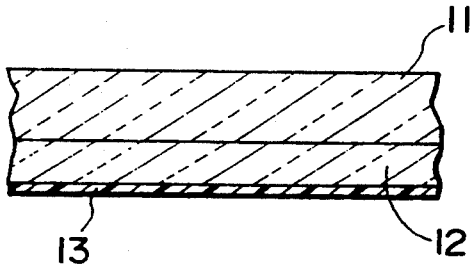
FIG. 1 is a partially enlarged sectional view of a screen in accordance with a first embodiment of the invention.

FIG. 1 is a partially enlarged sectional view showing a face region of a cathode-ray tube in accordance with a first embodiment of this invention.

This face region is constituted of an exterior layer 11 and an interior layer 12. Upon the inside of the interior layer 12 (an innermost surface of the face region exposed in vacuum) is deposited a phosphor layer 13.

The exterior layer 11 is formed of glass having a larger X-ray absorption coefficient.

Specifically, the exterior layer 11 has a thickness of $t_o=3.6$ (mm), an X-ray absorption coefficient of $\mu_o=62.0$ ($cm^{-1}$) and a density $\rho_o=3.0$ (g/cm).

This exterior layer 11 is formed of a material of "LOF 03" specified in the standards of the Electronic Industries Association of Japan (EIAJ) in this first embodiment.

In the meantime, the interior layer 12 is formed of glass which is hard to cause browning phenomenon.

Particularly, the interior layer 12 has a thickness of $t_i=2.0$ (mm), an X-ray absorption coefficient of $\mu_i=28.0$ ($cm^{-1}$) and a density of $\rho_i=2.79$ ($g/cm^{-3}$).

This interior layer 12 is also formed of glass of "H8602" specified in the standards of the EIAJ. This glass has conventionally been used, and has such a high reputation as not cause any adverse effects especially that of browning.

These exterior layer 11 and interior layer 12 are sealed together.

Hence, since the screen region has the thus-mentioned structure, the X-rays can be prevented at almost same level as is achieved in the conventional cathode-ray tube. In addition, the thickness of the screen region is about 10.0 mm in the conventional cathode-ray tube. On this point, however, in accordance with the cathode-ray tube embodying the present invention, the thickness can be reduced to as thin as 5.6 mm, thereby reducing the weight of the cathode-ray tube as a whole. For reference, referring to the weight ratio between the conventional cathode-ray tube and that of the present invention, the cathode-ray tube of the present invention has a weight ratio of 58.7% compared to the conventional cathode-ray tube of 100%.

Second Preferred Embodiment

Figure 2:
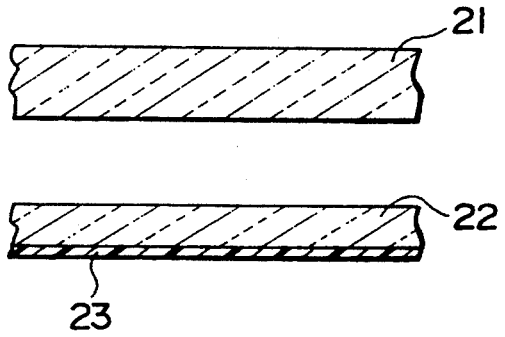
FIG. 2 is a partially enlarged sectional view of a screen in accordance with a second embodiment of the invention.

Next, FIG. 2 is a partial enlarged sectional view showing a screen region.

In this embodiment, there is a gap between an exterior layer 21 and an interior layer 22, the screen is assembled with these two layers spaced from each other at a given distance.

The space in this gap is maintained in vacuum but not always limited to the vacuum state.

Both exterior and interior layers 21, 22 have the same thickness as well as are formed of the same glass as of the exterior and interior layers of the cathode-ray tube in accordance with the first embodiment. In addition, on the inside of the interior layer 22 is deposited a phosphor layer 23.

The interior layer 22 and the exterior layer 23 are connected together, for instance, at the periphery of the screen region. As an alternative method, the exterior layer 21 may be attached to a non-illustrated metal frame encompassing the face panel.

Third Preferred Embodiment

Figure 3:
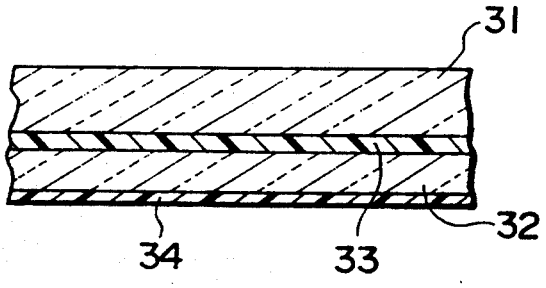
FIG. 3 is a partially enlarged sectional view of a screen in accordance with a third embodiment of the invention.

FIG. 3 is a partially enlarged sectional view showing a screen region of a cathode-ray tube in accordance with a third embodiment of the present invention.

In accordance with this embodiment, the screen region comprises an exterior layer 31, an interior layer 32 and a transparent adhesive layer 33 interposed between the exterior layer 31 and the interior layer 32. Moreover, on the innermost surface of the interior 32 is deposited a phosphor layer 34.

Likewise, the exterior layer 31 is formed of glass having a larger X-ray absorption coefficient, while the interior layer 32 is formed of glass which hardly causes browning phenomenon.

Practically, both the exterior layer 31 and the interior layer 32 have the same thickness as well as are formed of the same glass as of the exterior and interior layers of the first and second embodiments.

The adhesive layer 33 consists of resin or the like and acts to connect the exterior layer 31 and interior layer 32 together.

The material of this adhesive layer 33 is preferably be a material having a refractive index almost equivalent to that of glass when cured, so as not to cause unnecessary refraction of light emitted from the phosphor layer 34.

In accordance with this embodiment, the resin layer 33 is formed to have a thickness of about 1 mm.

Fourth Preferred Embodiment

Figure 4:
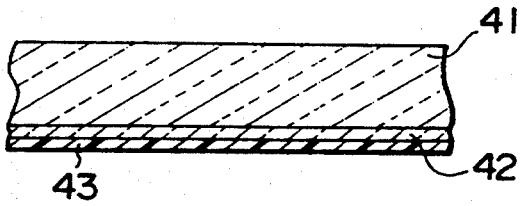
FIG. 4 is a partially enlarged sectional view of a screen in accordance with a fourth embodiment of the invention.
Figure 5A:
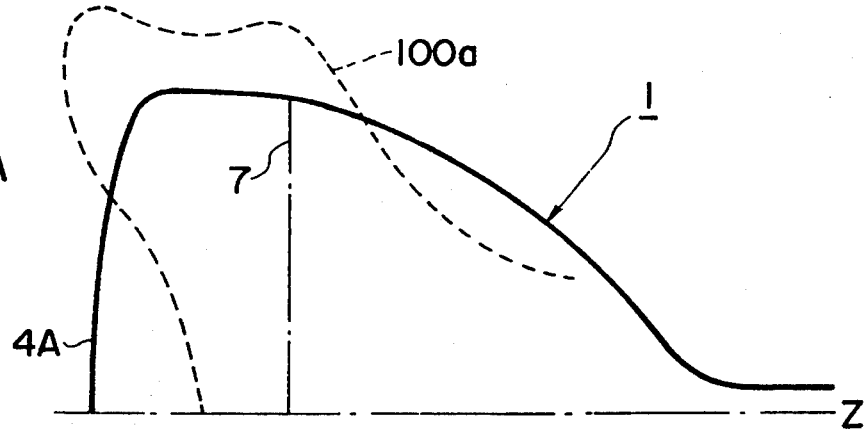
FIG. 5A, 5B and 5C are an explanatory view for reference use showing a distribution of stress produced over a conventional cathode-ray tube.
Figure 5B:
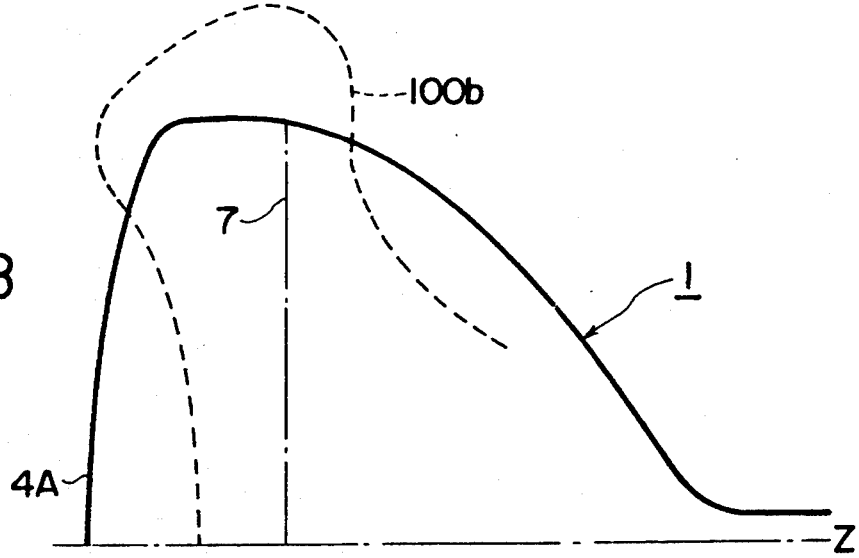
Figure 5C:
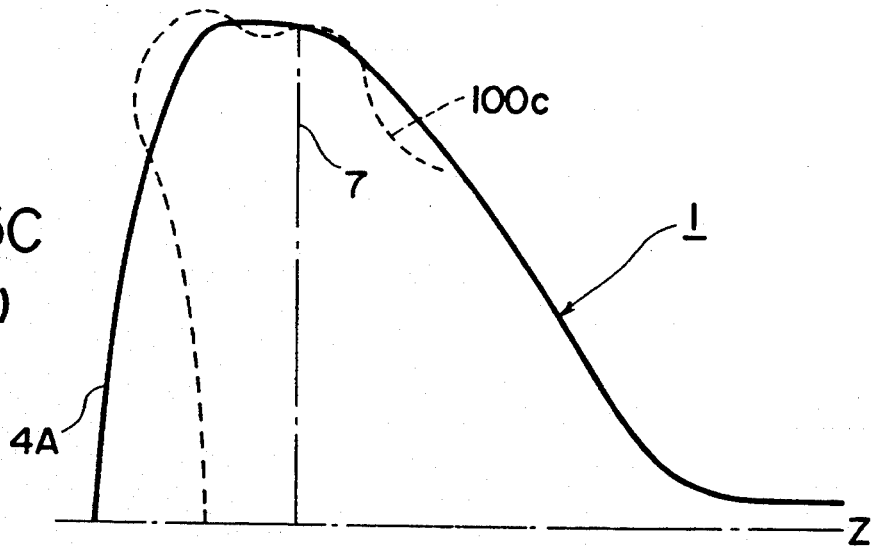
Figure 6:
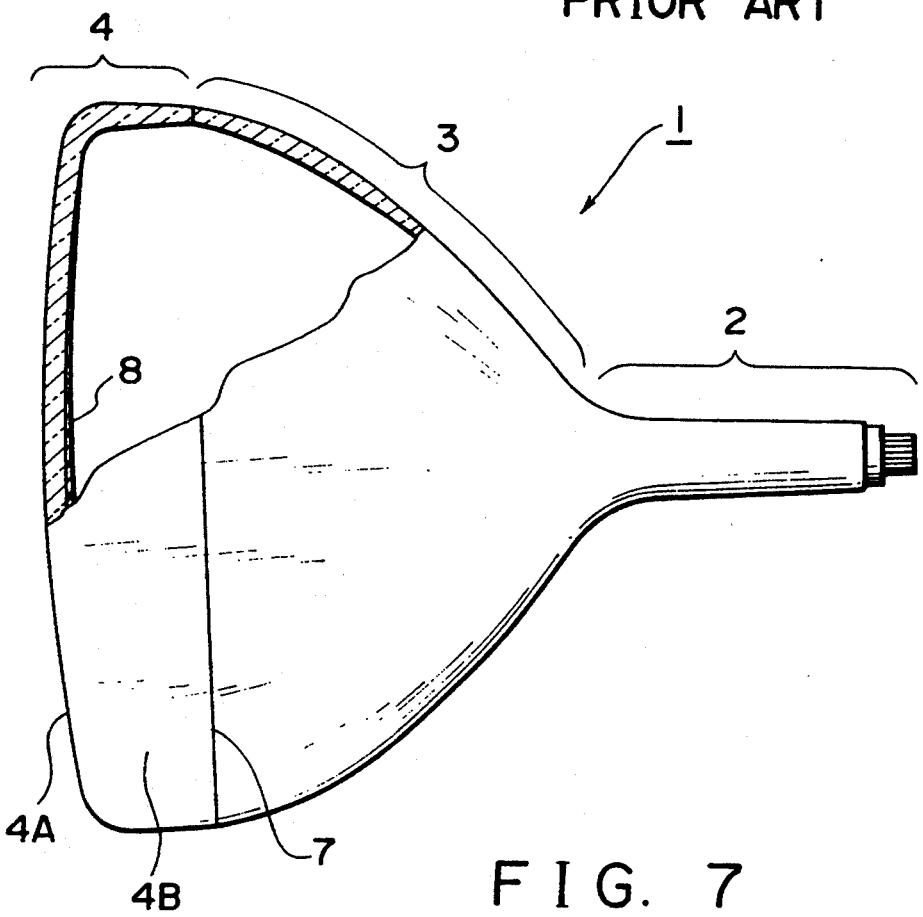
FIG. 6 PRIOR ART
FIG. 6 is a partially cutaway sectional view of a screen in accordance with the conventional cathode-ray tube.
Figure 7:
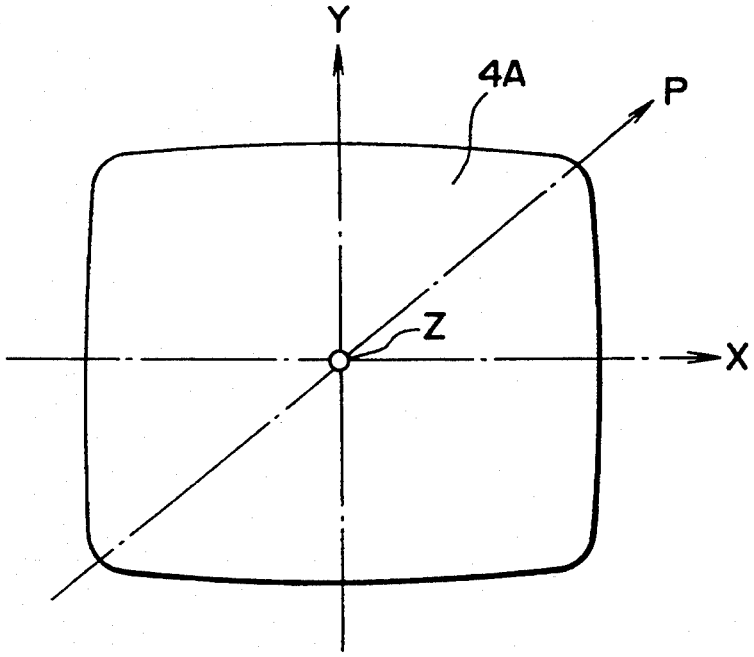
FIG. 7 is an explanatory view for explaining the coordinate system.

FIG. 4 is a partially enlarged sectional view showing a face region of a cathode-ray tube In accordance with a fourth embodiment of the present invention.

In this embodiment, an exterior layer 41 and an interior layer 42 are respectively formed of glass the same as of the exterior and interior layers of the embodiments set forth.

The exterior layer 41 has a thickness of $t_o=4.5$ (mm), whereas the interior layer 42 has a thickness of $t_i=0.2$ (mm).

In general, browning phenomenon occurred on glass is approximately 100 μm. Therefore, browning can be sufficiently prevented at the screen region of the cathode-ray tube in accordance with this invention because the interior layer 42 is formed thicker than the thickness which may cause browning and a perfect protection to the exterior layer 41 is realized.

Alternatively, this interior layer 42 may be formed by means of a method of producing a film by baking after a coating has been formed.

As mentioned above, since the screen region is composed of the foregoing exterior and interior layers, X-ray are sufficiently weakened at the exterior layer, whereas the browning phenomenon due to electron beams can be securely prevented at the interior layer.

With this result, it becomes possible to reduce the weight of the cathode-ray tube itself as well as the thickness of the face region maintaining the strength against implosion of the cathode-ray tube as ever and sufficiently suppressing the X-ray leakage emanated outwardly from the screen.

The above-described advantage can be obtained if at least the screen region is constituted of the above two glass plates. An overall face plate may be composed of two glass plates. In such a case, the fabrication of face panel will be facilitated.

The various features and advantages of the invention are thought to be clear from the foregoing description. However, various other features and advantages not specifically enumerated will undoubtedly occur to those versed in the art, as likewise will many variations and modifications of the embodiments illustrated herein, all of which may be achieved without departing from the spirit and scope of the invention as defined by the appended claims.

What is claimed is:

1. A cathode-ray tube having a face panel wherein the face panel further comprises:

(a) a screen region for displaying an image; and (b) a skirt region elongated from a periphery of the screen region;

the screen region further including:

(i) an exterior glass layer having an X-ray absorption coefficient and being of a predetermined thickness; and (ii) an interior glass layer having an X-ray absorption coefficient different from the X-ray absorption coefficient of the exterior glass layer and being of a predetermined thickness less than the predetermined thickness of the exterior glass layer such that the combined thickness of the interior and exterior glass layers is less than 10 mm, the screen region being void of a liquid coolant layer between the interior and exterior glass layers.

2. The cathode-ray tube of claim 1, wherein the x-ray absorption coefficient of the exterior layer is larger than that of the interior layer.

3. The cathode-ray tube of claim 2, wherein the exterior glass layer and the interior glass layer are connected together.

4. The cathode-ray tube of claim 3 wherein the exterior glass layer and the interior glass layer are connected together by a transparent adhesive having a refractive index equivalent to that of glass.

5. The cathode-ray tube of claim 2, wherein the exterior glass layer is superimposed over the interior glass layer with a predetermined air gap therebetween.

6. The cathode ray tube of claim 1, wherein the combined thickness of the exterior glass layer and the interior glass layer is 5.6 mm or less.

7. The cathode ray tube of claim 1, wherein the predetermined thickness of the exterior glass layer is approximately 3.6 mm.

8. The cathode ray tube of claim 1, wherein the predetermined thickness of the exterior glass layer is approximately 4.5 mm.

9. The cathode ray tube of claim 1, wherein the predetermined thickness of the interior glass layer is approximately 2.0 mm.

10. The cathode ray tube of claim 1, wherein the predetermined thickness of the interior glass layer is approximately 0.2 mm.

11. A face panel for use in a cathode ray tube, comprising:

a screen region for displaying an image, including, an exterior glass layer of a predetermined thickness and having an x-ray absorption coefficient, and an interior glass layer of a predetermined thickness less than the predetermined thickness of the exterior glass layer and having an x-ray absorption coefficient less than the x-ray absorption coefficient of the exterior glass layer, such that the combined thickness of the interior and exterior glass layers is less than 10 mm, the screen region being void of a liquid coolant layer between the interior and exterior glass layers; and a skirt region elongated from a periphery of the screen region.

12. The face panel of claim 11, wherein the exterior glass layer and the interior glass layer are connected together.

13. The face panel of claim 12, wherein the exterior glass layer and the interior glass layer are connected together by a transparent adhesive having a refractive index equivalent to that of glass.

14. The face panel of claim 11, wherein the exterior glass layer is superimposed over the interior glass layer with a predetermined air gap therebetween.

15. The face panel of claim 11, wherein the combined thickness of the exterior glass layer and the interior glass layer is 5.6 mm or less.

16. The face panel of claim 11, wherein the predetermined thickness of the exterior glass layer is approximately 3.6 mm.

17. The face panel of claim 11, wherein the predetermined thickness of the exterior glass layer is approximately 4.5 mm.

18. The face panel of claim 11, wherein the predetermined thickness of the interior glass layer is approximately 2.0 mm.

19. The face panel of claim 11, wherein the predetermined thickness of the interior glass layer is approximately 0.2 mm.

* * * * *